United States Patent [19]

Horowitz et al.

[11] 4,006,749

[45] Feb. 8, 1977

[54] REMOVAL OF HARMFUL COMPONENTS FROM TOBACCO SMOKE

[75] Inventors: Carl Horowitz; Michael Dichter; Nathan Abrams, all of Brooklyn; Duryodhan Mangaraj, Staten Island, all of N.Y.

[73] Assignee: Consolidated Cigar Corporation, New York, N.Y.

[22] Filed: Jan. 31, 1975

[21] Appl. No.: 545,988

[52] U.S. Cl. ..... 131/17 R; 131/15 R

[51] Int. Cl.[2] ..... A24B 15/07

[58] Field of Search ..... 131/2, 9, 15, 17, 261–267, 131/17 R, 140; 117/47

[56] References Cited

UNITED STATES PATENTS

| | | | |
|---|---|---|---|
| 3,459,195 | 8/1969 | Silberman | 131/17 R |
| 3,608,564 | 9/1971 | Takahashi et al. | 131/269 |
| 3,698,931 | 10/1972 | Horowitz | 117/47 |
| 3,774,623 | 11/1973 | Merrill | 131/17 R |
| 3,842,845 | 10/1974 | Cartwright | 131/2 |
| 3,863,645 | 2/1975 | Tso | 131/140 B |

*Primary Examiner*—Robert W. Michell
*Assistant Examiner*—V. Millin
*Attorney, Agent, or Firm*—William R. Liberman

[57] ABSTRACT

This invention provides a process for so treating tobacco, for use in cigars or cigarettes, as to activate the surface of the tobacco to remove the undesirable components of the smoke as the smoke passes along the cigar or cigarette, before reaching the smoker. The process provides for grafting onto the cellulosic constituents of the tobacco a graft polymer or copolymer having free functional groups reactive with the undesirable component of the tobacco smoke. The cellulosic constituents can be activated by an ionic or free radical process to yield a reactive site on the cellulosic chain which can subsequently be reacted with monomers containing active double bonds, e.g., olefins, vinyl monomers or acrylic monomers as well as polymerizable ring compounds each having the desired active substituents. Preferably, this invention is applicable to treating tobacco so as to provide a graft polymer or copolymer containing acidic groups which can react with the basic, or alkaline, components of tobacco smoke. This invention also provides an activated tobacco comprising graft polymers or copolymers formed on its surface.

26 Claims, No Drawings

REMOVAL OF HARMFUL COMPONENTS FROM TOBACCO SMOKE

This invention relates to the activation treatment of tobacco to render the tobacco effective in the removal of undesirable or toxic components from tobacco smoke during smoking.

It has been recognized that a large number of the components produced by the burning of tobacco during smoking are toxic or diminish the pleasure of the smoker during smoking. As a result, a wide variety of materials and methods have been suggested by the prior art for removing, generally by filtration, these undesirable components from the tobacco smoke. Thus, material such as cotton, paper, asbestos, regenerated cellulose and various synthetic fibers have been disclosed and suggested as filter media to remove these undesirable elements from tobacco smoke. Generally, most of the prior art filter media act in a purely physical manner, by removing particulate or liquid-solid phase high boiling materials from the smoke. However, the prior art did recognize that many of the physiologically harmful or taste-degrading components could be removed by chemical means. For example, it has been suggested to remove certain undesirable aldehydes from tobacco smoke by applying to a filter material (for example, as used in cigarettes) polymers and other agents having functional groups which are reactive with aldehydes, e.g., polymers having functional amino groups, amine salts or polyamines, (see U.S. Pat. Nos. 2,881,772 and 3,003,504). It has also been suggested to apply to a filter a complexing agent for the removal of certain undesirable phenolic components from the tobacco smoke. The filter fibers are impregnated with polymers having groups reactive with these phenolic materials (see U.S. Pat. Nos. 3,217,719 and 3,246,655). It has also been disclosed to impregnate or coat a filter material with an "oxidative resin" (see U.S. Pat. No. 2,800,908); to impregnate a filter with slightly polymerized furfural and a strong base to remove undesirable polynuclear hydrocarbons (U.S. Pat. No. 2,834,354); and to use a powder, formed of a graft copolymer of polyvinyl acetate or polyvinyl alcohol, copolymerized with a copolymerizable vinyl compound (such as an acrylate) in admixture with a fibrous filter medium to remove tars and nicotine (see U.S. Pat. No. 3,608,564). Similarly, it has been suggested to treat cigarette filters with alkaline materials, such as poly(alkyleneimines), to selectively remove from the tobacco smoke undesirable, volatile, acidic components, such as phenolics, while permitting a major proportion of other materials, such as nicotine, to pass through. On other occasions filters have been treated with acidic materials to remove nicotine from the tobacco smoke (see U.S. Pat. No. 3,340,879).

The art also recognized the possibility of admixing an active agent with the tobacco to remove the undesirable elements from the tobacco smoke. For example, tobacco has been treated by applying a polyvinyl pyrrolidone to the tobacco. The thus treated tobacco acts to remove tars, resins and nicotine from the smoke (see U.S. Pat. No. 2,707,959). The removal of various polynuclear aromatic hydrocarbons, such as pyrene and anthracene has been suggested by utilizing a polysiloxane solid adsorbent, in the form of fine particles, admixed with the tobacco or with the filter fiber. Preferably, the polysiloxane includes an endothermic reactant so as to act to maintain a low temperature and thus prevent the vaporization of any of the hydrocarbon materials once they are adsorbed (see U.S. Pat. No. 3,774,623). It has also been known to admix certain alkaline salts with the tobacco to remove volatile acidic components from the tobacco smoke (see U.S. Pat. No. 3,340,879).

It has now been discovered that tobacco, of the types used for smoking, and, more particularly, of the types used in the manufacture of cigars and cigarettes, can be treated so as to render the tobacco, in effect, self-filtering. In other words, the tobacco, as treated, is capable of removing the undesirable, or harmful, components of the tobacco smoke.

In accordance with the present invention, tobacco is treated to intimately bond, or graft, polymers or copolymers thereto, which are intimately associated with the tobacco, and which include free functional groups which are reactive with the particular undesired components which are to be removed from the smoke before it is inhaled. This invention further provides treated tobacco having the capability of removing the undesired components from the tobacco smoke.

More particularly, certain monomers or prepolymers are reacted at activated sites along the chains of the cellulosic constituent of the tobacco, to form a polymeric or copolymeric substituent which is intimately bonded, or grafted, onto the cellulose; the polymer remains with a sufficient number of active functional groups to react with and hold the undesirable components in the tobacco smoke. Most preferably, this invention can be used for the removal of certain basic nitrogenous materials from tobacco smoke by utilizing monomers or prepolymers which contain free acidic functional groups in the formation of the graft polymer. The reactive monomers are preferably vinyl or acrylic monomers. Useful acid function groups include: carboxyl(—COOH), sulfate(—$SO_3H$), phosphate(—$OPO(OH)_2$), and phosphite(—$OP(OH)_2$), and acid chloride (COCl). Groups such as the acid chlorides, however, which may form toxic by-products if burned, should only be used for a part of a special filter. This invention can also be used to remove phenolic and acidic carboxylic compounds from smoke by utilizing monomers or prepolymers which contain free basic functional groups, especially amine-containing monomers such as methacrylamide, diacetone acrylamide, and preferably the non-toxic vinyl pyrrolidone.

In accordance with a preferred aspect of the present invention, the cellulosic constituents of the tobacco are activated by either an ionic or free radical process to yield a reactive site capable of being grafted to by a copolymerizable monomer, including double bond-containing vinyl monomers, including for example, the acrylic monomers, vinyl chloride and the vinyl esters, as well as metastable cyclic compounds that polymerize by ring opening to form a graft polymer chain at that site. Methods of grafting polymers onto cellulosic substrates have been previously disclosed, for example, in U.S. Pat. Nos. 3,401,049 and 3,698,931.

In accordance with the preferred prior process of U.S. Pat. No. 3,698,931, the cellulosic substrate is contacted with a solution comprising a dissolved free silver salt and a polymerizable composition including a catalyst, which is adapted to be activated to catalyze polymerization by silver oxide or colloidal silver, and polymerizable or copolymerizable monomers. The silver salt is reduced to colloidal silver or silver oxide by the cellulose substrate. The silver or silver oxide bonds to the cellulose at the sites where it is reduced, which are themselves thus rendered active; the silver or silver oxide in turn activates the catalyst again at the activated point on the cellulose chain to initiate the polymerization of the monomers which are present at the activated site of the cellulose chain. The polymer formed at the cellulosic site is thus intimately bound, by grafting, to the cellulose. In the preferred example, an acid functional group on the polymer can react with the undesirable basic components in the smoke.

Although the exact mechanism by which the graft polymer is formed and then reacts with the undesirable components does not form a part of this invention, it is believed that in one example of such a system it proceeds in accordance with the following reaction diagram:

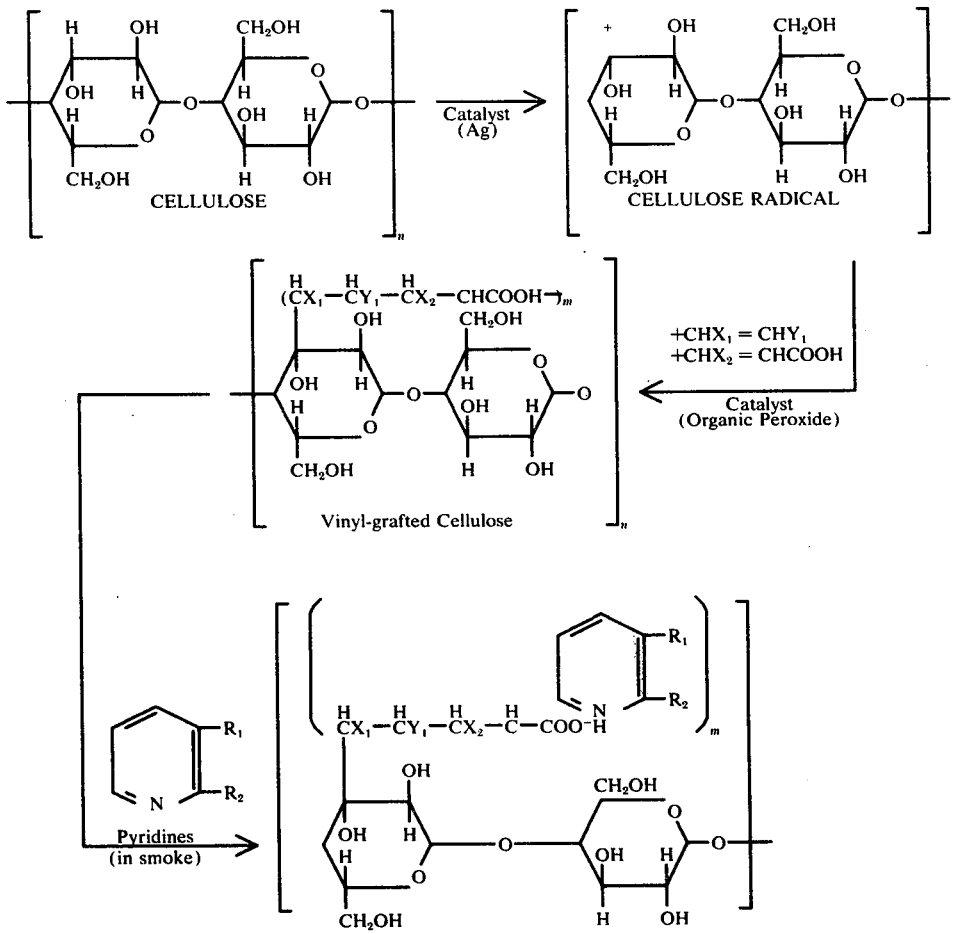

In the above formulae, X and Y are hydrogen, organic groups, non-functional groups, or acid functional groups; R groups are hydrogen or organic groups; and m and n are numbers describing chain length of polymers. The value of the *m* is not critical to the present invention, as long as there are sufficient functional groups in total to combine with the undesirable components.

In the first step of the above reaction, the silver ion is believed to be reduced to colloidal silver when a free radical site (⊗) is formed on the cellulose chain. In the second step, one of the vinyl and acrylic monomer molecules, catalyzed by the presence of an organic peroxide type catalyst, which is in turn activated by the colloidal silver, attaches itself to the radical site, and additional vinyl and acrylic monomers are then connected thereto to form the graft polymer chain. As indicated in this example, the grafted polymer chain comprises alternate vinyl monomer and acrylic acid monomer units. The carboxyl group on the acrylic acid unit remains a free functional acid group for the purposes required for this invention.

Finally, in a reverse reaction not indicated herein, the colloidal silver is oxidized by the action of the organic peroxide catalyst back to its ion valence state, from which it can then repeat the entire cycle with a fresh site on the cellulose chain substrate.

In the final step shown in the above series of reaction steps, the basic organic materials which are present in the tobacco smoke, exemplified by the pyridine derivatives illustrated, react with the free carboxyl groups on the graft polymer chain. The amount of such undesirable basic materials remaining in the inhaled smoke is thus substantially reduced.

There is also likely to be some polymerization of the monomers which are not grafted onto the tobacco. Such polymers can be coated onto the leaf for effectiveness in the filtration process. If desired, the ungrafted polymers can be removed by leaching or elution.

The basic organic compounds are believed to be nicotine and the combustion products of the nicotine from the burning tobacco. Cigarette smoke is believed to be primarily the result of the combustion of cellulose and nicotine. The cellulose generally gives rise to volatile, neutral or acidic compounds; nicotine, although it can be volatilized and removed without degradation in the tobacco smoke, often decomposes to form other basic compounds such as pyridine, picolines, lutidines, ethyl pyridine, vinyl pyridine, etc. It is thus believed necessary to remove these basic materials from the smoke to as great an extent as possible in order to avoid toxic physiological effects, including the narcotic effect of the nicotine. Any aromatic materials, which it is believed provide the desirable flavor for cigarette smoke, can be maintained at the optimal level without being affected by the treated tobacco with the acidic graft polymer substituent.

In preparing the tobacco so as to graft the desirable free functional groups thereon, a grafting solution is prepared containing polymerizable monomers and/or prepolymers having the desirable free functional groups, e.g., acid groups, in addition to the polymerizing functionality, such as the vinyl double bond present in olefins, vinyl halides and esters, and acrylic monomers or the metastable ring of the cyclic monomers, e.g., cyclic acid anhydrides. The term "acrylic monomers", when used in this context, is intended to include not only acrylic acid and esters of acrylic acid, but also the various alkacrylic acids and esters thereof, especially methacrylic acid and its esters. Together with the monomer and/or prepolymers, there should also be present in the grafting solution the initiation system comprising the silver ion and the organic peroxides.

Useful free acid function-containing monomers and prepolymers include, for example, itaconic acid, citric acid, acrylic acid, methacrylic acid, sodium styrene sulfonate, sodium vinyl sulfonate, and bis(betachloroethyl)vinyl phosphonate. Such monomers can be used alone or together with copolymerizable comonomers such as vinylidene chloride, vinyl chloride, chloroprene, isoprene, dimethylaminoethyl methacrylate, styrene, 1.3-butylene dimethacrylate, isooctylvinyl ether, isobutyl vinyl ether, acrylonitrile, acrylamide, N-vinyl pyridine, glycidyl methacrylate, N-vinyl caprolactam, N-vinyl pyrrolidone, N-vinyl carbazole, ethyl acrylate, ethyl methacrylate, isobutylmethacrylate, methyl acrylate, cetyl vinyl ether, divinylether of ethylene glycol, divinyl ether of butanediol, vinyl toluene, vinyl acetate, octadecyl vinylether. Also mixtures of two or more functional monomers can be used.

Additional monomers are:

Mono, di-, tri-, tetra- and polyethylene glycoldimethacrylate, methylvinylpyridine, allylacrylate and methacrylate, allylchloride, allylalcohol, perfluoro alkyl acrylates and methacrylates, p-amino-styrene, vinyl bromide and vinylidene bromide, trimethylvinylbenzylammonium chloride, vinyltrifluoroacetate (followed by hydrolysis to poly-vinyl alcohol), diallyl chloromethyl phosphonate, diallyl benzene phosphonate, diallyl dimethyl ammonium chloride, diallyl diethyl ammonium bromide, glycidyl acrylate and methacrylate, ethylene glycol, diethyleneglycol- and polyethylene glycol acrylates and methacrylates, vinyl perluoro octanoate, etc.

In addition, certain prepolymers, e.g., partially polymerized groups, can be utilized in accordance with the present invention to provide the desired, e.g., acidic, functional groups; included, for example, are methylvinylether maleic anhydride copolymer, its half-ester such as the butyl half-ester, as well as prepolymers made of styrene, maleic anhydride and ethylene maleic anhydride.

The desired monomers and/or prepolymers are then dissolved in a suitable solvent including, for example, water, ethanol, isopropanol, ethyl acetate, methyl ethyl ketone, acetone, dioxane and diglyme. Mixtures of two or more of the useful solvents can be used.

The silver activation agent can be in the form of substantially any soluble silver salt including, for example, silver nitrate, silver acetate, and silver sulfate. Where water is not present as at least one of the monomer solvents, silver perchlorate or other salts soluble in organic solvents should be utilized.

Useful catalysts for the above-exemplified polymerization should be free radical initiators as well as strong oxidizing agents, such as ammonium persulfate, hydrogen peroxide, and the organic peroxides, including tert-butylhydroperoxide, ditertbutyl peroxide, benzoyl peroxide, dicumyl peroxide, lauroyl peroxide, tert-butyl perbenzoate and peracetic acid.

The concentration of the silver salt in the grafting solution can be in the range of from about 0.0001% to about 0.01% by weight of silver, and, preferably, not more than about 0.001% by weight of silver, for the above-exemplified grafting method. The concentration of the monomer in the treatment solution can be in the range of from about 0.1% to about 50% by weight monomer per total weight of the solution, but preferably from about 1% to about 20% by weight.

In carrying out the specific example of the grafting process of this invention described, the grafting is carried out from a solution of water and/or other relatively low-boiling liquids. Thus, the maximum temperature must be below the boiling point of the solution. The minimum temperature is determined only by the desired speed of the reaction. Preferably, the grafting is carried out at a temperature in the range of from about 30° C. to about 90° C.

In selecting the useful monomers, or prepolymers, solvents, silver salts and catalysts, the use to which the graft polymer is to be put must be kept foremost in mind. The various materials selected are preferably all non-toxic when inhaled or swallowed by human beings, and, further, any combustion or decomposition products of such materials must similarly be nontoxic to human beings. Further, in order to ensure that a commercially useful tobacco product is obtained, the various materials selected must introduce no unpleasant taste to the tobacco when smoked or in the case of a cigar when placed in contact with saliva in the mouth, or when chewed.

In treating the tobacco to obtain the desired smoke-filtering activity, the desired activity can be obtained, for example, by treating the tobacco prior to forming the cigar or cigarette, such as by spraying the binder sheet used in manufacturing cigars, or by spraying the shredded tobacco used as filler in the manufacture of cigars or of cigarettes, or by treating the finished smoking tobacco such as by dipping the head of the cigar into the grafting solution and obtaining the desired activity only in the portion which will generally not be itself burned during smoking. This avoids the problem of any undesirable or unpleasant tasting by-products of combustion from the graft polymer being inhaled.

In the latter case, when dipping the head of the completed cigar, it is important that the treatment not change the taste of the cigar nor the "mouth-feel" of the cigar during smoking. It has been found that, as a result of the above treatment to obtain smoke filtration activity in the tobacco head, or tip, in accordance with the present invention, the head of the cigar can also be strengthened so as to diminish or eliminate the problem of shredding of the tip by chewing during smoking.

It must be understood, therefore, that this invention encompasses the use of the graft polymers or copolymers distributed substantially evenly throughout the length of the cigar or cigarette as well as the use of the graft copolymer or polymer (that is the filter-activated tobacco sites) only at the head of the cigar. Generally, the concentration of the graft polymer on the tobacco can be from about 5% to about 10% by weight of the total weight of tobacco present, as measured by the increase in weight, or "dry pick-up", following the formation of the graft polymer.

The following examples illustrate preferred embodiments of the present application. They are intended to be exemplary but not exclusive of the scope of this invention which is fully defined by the claims set forth below:

EXAMPLE I

A grafting solution was prepared in accordance with the following procedure. Methyl vinyl ether maleic anhydride copolymer (50 grams) was dissolved, with mixing, in boiling water (400grams) until a clear solution was obtained. The aqueous solution was then partially cooled and admixed with itaconic acid (50 grams) and silver nitrate (0.025 grams). To ethyl alcohol (450 grams) methyl vinyl iso-butyl ether (50 grams) and methyl ethyl ketone peroxide (1 gram) were added. The alcoholic solution was then carefully added to the aqueous solution and maintained at 60° C. for 30 minutes, to form a graft polymer treating solution having the following formulation:

| Compound | Parts by wt. |
|---|---|
| Methyl vinyl iso butyl ether | 50 |
| Itaconic acid | 50 |
| Methyl vinyl ether-maleic anhydride copolymer | 50 |
| Water | 400 |
| Silver nitrate | 0.025 |
| Ethyl alcohol | 450 |
| Methyl ethyl ketone peroxide | 1 |

A commercially available cigar (Muriel "Magnum" cigars, manufactured by the Consolidated Cigar Corporation) was dipped to a depth of one inch, from the tip or head, into the grafting solution and held there, at a temperature of 60° C., for 2 minutes. The cigar was removed therefrom and permitted to drain while being held in a vertical position for three minutes. The wet cigar was placed in an air oven maintained at 35° C. to 40° C. and dried overnight. The dried cigar was then rehumidified at 85% relative humidity and then smoked in a smoking apparatus.

The smoking apparatus consisted of a cigar holder (glass) connected through glass tubing to a 250 ml. flask containing 125 ml. distilled water, which was in turn connected to a second flask containing 100 ml. of distilled water, both maintained at substantially room temperature. The water in the flasks scrubs the basic materials from the smoke passing from the cigar, i.e. the smoke that would be inhaled by a human smoker.

Following smoking of one-half the length of the cigar, the scrub water solutions in the two flasks were combined and analyzed for pH and for the quantities of nicotine and pyridine and its derivatives which were dissolved therein. An identical control cigar, which had not been treated utilizing the grafting polymer solution in accordance with the present invention, was also test-smoked for the same period utilizing the same smoking apparatus. The pH of the combined scrub water solutions from the control cigar was 7.6. The pH of the combined scrub water solutions from the cigar treated in accordance with this invention was 6.4. In separate tests which were carried out, with two cigars treated as above, the quantities of nicotine and pyridine found in the aqueous solution were about 44% and about 37% by weight, respectively, less than the levels found for the corresponding control cigar.

EXAMPLE 2

An aqueous solution was prepared as above containing silver nitrate, citric acid, itaconic acid and methyl vinyl ether maleic anhydride co-polymer. An ethanol solution was prepared as in Example 1, containing methyl vinyl ether maleic anhydride butyl half ester, and methyl ethyl keytone peroxide. A graft polymer treating solution having the following formula was obtained:

| Compound | Parts by wt. |
|---|---|
| Itaconic acid | 25 |
| Citric acid | 25 |
| Methyl vinyl ether-maleic anhydride Copolymer (MVEMA) | 40 |
| MVEMA butyl half ester | 30 |
| Water | 430 |
| Silver nitrate (0.5% solution) | 0.025 |
| Ethanol | 450 |
| Methyl ethyl ketone peroxide | 1 |

A commercially available cigar, in this case a Muriel "Corona" cigar (manufactured by the Consolidated Cigar Corporation) was treated by dipping the head and drying, followed by rehumidifying in the manner set forth in Example 1. The cigar was then smoked in automatic smoking machines and compared with the results from smoking an untreated Muriel "Corona", as set forth in Example 1.

The pH of the scrub water solution collected from the control cigar was 7.4. The pH of the scrub water solution collected from the treated cigar was 5.6. Analysis of the scrub water solution showed that the level of nicotine and pyridine in the scrub water decreased by about 49% and 56% by weight, respectively, for two treated cigars compared to an untreated cigar. It was further found in this case that the tar level decreased by 20%.

EXAMPLE 3

The procedures of Example 2 were repeated, using a graft polymer treating solution having the following formulation:

| Compound | Parts by wt. |
|---|---|
| Ethyl vinyl ether maleic anhydride copolymer; ethyl half ester | 2.5 |
| Water | 48.25 |
| Citric acid | 2.5 |
| Itaconic acid | 0.75 |
| $A_gNO_3$ (0.5% solution) | 0.002 |
| Vinyl pyrrolidone | 1.00 |
| Acetyl peroxide | 0.01 |

The scrub water solution from a Muriel "Corona" cigar had a pH of 4.9 compared to 5.8 from an untreated cigar. The amount of nicotine absorbed by the water from the treated cigar was 12% less than that for the untreated cigar.

EXAMPLE 4

The following test shows the effect of treating the shredded tobacco used as the filler material in cigars. A graft polymer treating solution having the following formulation was prepared:

| Compound | Parts by wt. |
|---|---|
| Methyl vinyl ether maleic anhydride | 4.000 |
| Ethyl half ester vinyl ether maleic anhydride | 3.000 |
| Itaconic acid | 2.000 |
| Citric acid | 5.000 |
| $A_gNO_3$ (0.5% solution) | 0.001 |
| Methyl ethyl ketone peroxide(10% isopropanol) | 0.100 |
| Deionized water | 46.000 |
| Isopropanol | 47.000 |
| Vinyl iso butyl ether | 1.000 |

Approximately 3 lbs. of shredded tobacco was sprayed with the above formulation to a dry pick-up of 1.8%. After drying at 50° C. overnight and rehumidifying at 90% relative humidity for 16 hours, a 5.5 gm. sample of the treated tobacco was used to refill a "hollowed out" commercially available cigar. An equal quantity of the same tobacco, but untreated, was used to refill an identically hollowed-out control cigar.

The cigars are automatically smoked, as in Example 1, and a similar decrease in the pH of the scrub water solutions is obtained for the treated cigar.

The examples set forth above are all directed to the graft polymerization of tobacco with monomers having acidic functional groups to remove the basic materials from the tobacco smoke. It has been suggested by earlier workers that other portions of the tobacco smoke could also usefully be removed in order to enhance the flavor or decrease the toxicity to human beings. This invention further contemplates the utilization of graft polymerization in the manner set forth above by utilizing monomers or prepolymers to form graft polymers having free functional groups which are reactive with other ingredients in the tobacco smoke, for example, phenolic components, polynuclear aromatic components, acidic components, or aldehydes. Polymers or copolymers bearing these functional groups could be grafted onto the tobacco in the same manner described above for the grafting of the acidic functional groups to remove the basic components from the tobacco smoke.

This invention is further not dependent upon the particular method of grafting the polymers having the desired functional groups onto the tobacco. In addition to the procedures explicitly described above, reference is made, for example, to U.S. Pat. No. 3,401,049 which discloses another method of grafting onto the tobacco substrate. Any other method suitable for grafting the desired polymer or copolymer chain onto the tobacco substrate, whether now known or subsequently developed, can be utilized in the practice of this invention, and thus falls within the scope thereof.

The term "polymer", when used herein broadly, is intended to encompass graft polymers or copolymers or interpolymers.

The patentable embodiments of this invention which are claimed are as follows:

1. A method of activating tobacco to remove an undesirable component of tobacco smoke passing therethrough, the method comprising grafting a polymer onto the tobacco substrate, the polymer having free functional groups available active to combine with and retain the undesirable component of the tobacco smoke which it is desired to remove.

2. The method of claim 1 wherein the polymer is grafted onto the tobacco by contacting a grafting solution comprising a monomer or prepolymer suitable for forming the desired graft polymer, activating a site on the cellulosic constituent of the tobacco, and initiating polymerization of the monomer or prepolymer, at the site to form the graft polymer.

3. The method of claim 2 wherein the graft polymer has acid functional groups active to combine with and retain basic components of the tobacco smoke.

4. The method of claim 3 wherein the grafting solution produces a cellulose free radical site on the cellulosic component.

5. The method of claim 4 wherein the monomer or prepolymer is selected from the group consisting of vinyl-type polymerizable monomers and cyclic monomers which polymerize by ring opening and contain a free acid function group.

6. The method of claim 5 wherein the grafting solution also comprises a second monomer or prepolymer copolymerizable with the monomer or prepolymer containing the free acid function group.

7. The method of claim 6 wherein the cellulose free radical activator is a dissolved silver salt.

8. The method of claim 7 wherein the grafting solution also comprises a free radical catalyst for the polymerization of the monomer or prepolymer.

9. The method of claim 5 wherein the acid group is selected from the group consisting of carboxyl, sulfonate, sulfate and phosphate the activated tobacco and the combustion products thereof being non-toxic when ingested.

10. The method of claim 9, wherein the grafting solution comprises a prepolymer selected from the group consisting of partially polymerized copolymers of maleic anhydride.

11. The method of claim 10, wherein the prepolymers are partially polymerized copolymers of maleic anhydride with a comonomer selected from the group consisting of ethylvinyl ether, styrene, ethylene, and methylvinyl ether.

12. The method of claim 11, wherein the copolymers of maleic anhydride are partially esterified.

13. The method of claim 9, wherein the grafting solution comprises a free acid function-containing monomer selected from the group consisting of itaconic acid, citric acid, acrylic acid, methacrylic acid, sodium styrene sulfonate and sodium vinyl sulfonate.

14. The method of claim 2 wherein the graft polymer has a basic functional group active to combine with and retain phenolic and carboxylic components of the tobacco smoke.

15. A method of forming a cigar capable of removing an undesirable component from the smoke during smoking comprising the steps of, in any order, forming tobacco into a cigar and treating the tobacco located at least at the head tip of the cigar to graft a polymer or copolymer onto the tobacco substrate, the polymer or copolymer having free functional groups available active to combine with and retain the undesirable component of the tobacco smoke which it is desired to remove.

16. The method of claim 15 wherein the cigar is initially formed, and at least the tobacco at the head tip of the cigar is so treated.

17. The method of claim 16, wherein only the tobacco at the head tip of the cigar is so treated.

18. The method of claim 15 wherein the tobacco is initially treated prior to forming the cigar.

19. A smoking composition comprising tobacco activated to remove an undesirable component from tobacco smoke passing therethrough, the tobacco comprising graft polymer chains formed thereon and extending from sites along the cellulosic constituent of the tobacco, the graft polymer chain including free functional groups reactive with the undesirable component of the tobacco smoke desired to be removed, and wherein the free functional groups are acid functional effective for removing nicotine and pyridine bases from the smoke.

20. The smoking composition of claim 19 wherein the graft polymer chains are polymers of a monomer or prepolymer selected from the group consisting of vinyl-type polymerizable monomers and cyclic monomers which polymerize by ring opening.

21. The smoking composition of claim 19 wherein the graft polymer chain is formed of an acrylic monomer or a vinyl monomer, containing a free acid group and a comonomer polymerizable therewith.

22. The smoking composition of claim 19, wherein the acid functional group is selected from the group consisting of carboxyl, sulfonate, sulfate and phosphate the activated tobacco and the combustion products thereof being non-toxic when ingested.

23. The smoking composition of claim 22, wherein the graft polymer chains are polymers of a vinyl-type polymerizable monomer selected from the group of free acid function-containing monomers consisting of itaconic acid, citric acid, acrylic acid, methacrylic acid, sodium styrene sulfonate, and sodium vinyl sulfonate.

24. The smoking composition of claim 22, wherein the graft polymer chains are polymers of a prepolymer selected from the group consisting of partially polymerized copolymers of maleic anhydride.

25. The smoking composition of claim 24, wherein the prepolymers are partially polymerized copolymers of maleic anhydride with a comonomer selected from the group consisting of ethylvinyl ether, styrene, ethylene and methylvinyl ether.

26. The smoking composition of claim 25, wherein the copolymers of maleic anhydride are partially esterified.

* * * * *